US008373119B2

(12) United States Patent
Reilly

(10) Patent No.: US 8,373,119 B2
(45) Date of Patent: Feb. 12, 2013

(54) METHODS OF ANALYZING COMPOSITION OF AEROSOL PARTICLES

(75) Inventor: Peter T. A. Reilly, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 13/561,365

(22) Filed: Jul. 30, 2012

(65) Prior Publication Data

US 2012/0298858 A1 Nov. 29, 2012

Related U.S. Application Data

(62) Division of application No. 12/418,891, filed on Apr. 6, 2009, now Pat. No. 8,288,716.

(51) Int. Cl.
*H01J 49/40* (2006.01)

(52) U.S. Cl. ..... 250/288; 250/281; 250/282; 250/423 R; 250/425; 250/423 P

(58) Field of Classification Search ..... 250/281, 250/282, 283, 286, 287, 288, 423 R, 424, 250/425, 423 P, 492.1
See application file for complete search history.

(56) References Cited

U.S. PATENT DOCUMENTS

| | | | | |
|---|---|---|---|---|
| 5,067,801 | A | 11/1991 | Mirels et al. | |
| 6,784,423 | B2 | 8/2004 | Reents, Jr. et al. | |
| 6,943,346 | B2 * | 9/2005 | Tan et al. | 250/288 |
| 6,972,408 | B1 * | 12/2005 | Reilly | 250/292 |
| 7,256,396 | B2 * | 8/2007 | Reilly | 250/288 |
| RE40,632 | E * | 2/2009 | Tang et al. | 250/282 |
| 7,671,330 | B2 * | 3/2010 | Reilly et al. | 250/290 |
| 2004/0045497 | A1 * | 3/2004 | Kriews et al. | 117/2 |
| 2005/0194543 | A1 * | 9/2005 | Hieke | 250/400 |
| 2005/0287308 | A1 * | 12/2005 | Becker et al. | 427/561 |
| 2007/0023679 | A1 * | 2/2007 | Reilly | 250/426 |
| 2007/0057177 | A1 * | 3/2007 | Kim et al. | 250/287 |
| 2009/0272893 | A1 * | 11/2009 | Hieftje et al. | 250/282 |

OTHER PUBLICATIONS

Lee et al., "Determination of the Size Distribution of Polydisperse Nanoparticles with Single-Particle Mass Spectrometry: The Role of Ion Kinetic Energy" Aerosol Science and Technology (2005) pp. 162-169, vol. 39.
Reents et al., "Measurement of Individual Particle Atomic Composition by Aerosol Mass Spectometry" Anal. Chem. (2001) pp. 5403-5414, vol. 73.
Reents et al., "Simultaneous Elemental Composition and Size Distributions of Submicron Particles in Real Time Using Laser Atomization/Ionization Mass Spectrometry" Aerosol Science and Technology (Jul.-Aug. 2000) pp. 122-134, vol. 33.
Wang et al., "A Design Tool for Aerodynamic Lens System" Aerosol Science and Technology (2006) pp. 320-334, vol. 40.

(Continued)

*Primary Examiner* — Michael Logie
(74) *Attorney, Agent, or Firm* — Scully, Scott, Murphy & Presser, P.C.

(57) ABSTRACT

An aerosol particle analyzer includes a laser ablation chamber, a gas-filled conduit, and a mass spectrometer. The laser ablation chamber can be operated at a low pressure, which can be from 0.1 mTorr to 30 mTorr. The ablated ions are transferred into a gas-filled conduit. The gas-filled conduit reduces the electrical charge and the speed of ablated ions as they collide and mix with buffer gases in the gas-filled conduit. Preferably, the gas filled-conduit includes an electromagnetic multipole structure that collimates the nascent ions into a beam, which is guided into the mass spectrometer. Because the gas-filled conduit allows storage of vast quantities of the ions from the ablated particles, the ions from a single ablated particle can be analyzed multiple times and by a variety of techniques to supply statistically meaningful analysis of composition and isotope ratios.

22 Claims, 5 Drawing Sheets

OTHER PUBLICATIONS

Wang et al., "Chemical Characterization of Individual, Airborne Sub-10-nm Particles and Molecules" Analytical Chemistry (Mar. 15, 2006) pp. 1750-1754, vol. 78.

Wineland et al., "Ion Traps for Large Storage Capacity" Proceedings of the Cooling, Condensation, and Storage of Hydrogen Cluster Ions Workshop (Jan. 1987) pp. 168-181.

* cited by examiner

Aerodynamic Lens System
Optical Detection System
Repeller
Extractor
Ablation Chamber
Beam Dump
532 nm YAG laser
Gas-Filled Quadrupole
Quad Chamber
Pump 1
Quad Chamber Cross Section
Einsel Lens
Mass spectrometer
Pump 2
Channeltron Detector
Conversion Dynode

METHODS OF ANALYZING COMPOSITION OF AEROSOL PARTICLES

CROSS REFERENCE TO RELATED APPLICATION

This application is a divisional of U.S. patent application Ser. No. 12/418,891, filed Apr. 6, 2009 the entire content and disclosure of which is incorporated herein by reference.

STATEMENT REGARDING FEDERALLY SPONSORED RESEARCH OR DEVELOPMENT

This invention was made with United States government support under Prime Contract No. DE-AC05-00OR22725 awarded by the U.S. Department of Energy. The United States government has certain rights in this invention.

FIELD OF THE INVENTION

The present invention relates to the field of analytical instrumentation and methods of operating the same.

BACKGROUND OF THE INVENTION

Analysis of aerosol particles by mass spectrometry provides useful information on the composition of the sample. For example, polluted air in cities may be sampled and analyzed to determine the source of pollutants in the city air. Lee et al., "Determination of the size distribution of polydisperse nanoparticles with single-particle mass spectrometry: The role of ion kinetic energy," AEROSOL SCIENCE AND TECHNOLOGY 39 (2): 162-169 February (2005), provides an exemplary instrumentation that may be employed to analyze the composition of aerosol particles. In this example, a single-particle mass spectrometer (SPMS) consists of an aerodynamic inlet region, a source region for particle-to-ions conversion with a free-firing pulsed laser, and a detector. Because the chamber which houses both the flight tube and the ionization region has a pressure of about $6\times10^{-7}$ Torr during the operation, the distribution of detected ions is determined by the composition and morphology of the particle and the dynamics of the ablation and mass analysis processes.

Reents et al., "Simultaneous elemental composition and size distributions of submicron particles in real time using laser atomization/ionization mass spectrometry," AEROSOL SCIENCE AND TECHNOLOGY 33:122-134 July-August (2000) discloses use of "dried" particles that are provided employing desiccated molecular sieves. Particles were introduced into the aerosol mass spectrometer, atomized and cationized by an intense laser beam, and the nascent ions were analyzed by a time-of-flight mass spectrometer. Because the mass spectrometer needs to operate in high vacuum ($<1.0\times10^{-6}$ Torr), only a minute portion of the created ions were sampled through the mass analyzer. The distribution of ions sampled into the analyzer depends on the composition and morphology of the individual particle and the dynamics of the ablation process. Consequently, the measured ion distribution does not necessarily correlate with the elemental composition of the particle. This is especially true when the particle has a non-homogeneous composition and morphology. Additionally, the mass analysis can only be performed one time per laser ablation event.

Thus, the prior art instrumentation requires ablation of aerosol particles at an high vacuum environment, and thereby limits the purity and composition of particles that may be analyzed effectively. Such a limitation practically prevents reliable real-time analysis of particles in an environment in which the composition, morphology and purity varies on an individual particle basis.

In view of the above, there exists a need for instrumentation for providing precise compositional analysis of individual aerosol particles. Particularly, there exists a need for a real-time particle analyzer that provides elemental composition analysis of particles sampled from the air or surfaces in real time.

SUMMARY OF THE INVENTION

In the present invention, an aerosol particle analyzer includes a laser ablation chamber, a gas-filled conduit, and a mass spectrometer. An aerosol particle supply system, which can employ, for example, an aerodynamic lens system, supplies aerosol particles into the laser ablation chamber. The laser ablation chamber can be operated at a low pressure, which can be from 0.1 mTorr to 30 mTorr. The gas-filled conduit reduces the electrical charge distribution and the speed of ablated particles as the ablated particles collide with buffer gases in the gas-filled conduit. Preferably, the gas filled-conduit includes an electromagnetic multipole structure that collimates the ions ablated from the aerosol particles, which are guided into the mass spectrometer. Because the gas-filled conduit allows storage and statistical mixing of the enormous number of ions from the ablated particles, the measured ion distribution correlates with the elemental composition of the individual particle. Ions from the same particle can be sampled from the large trap into the mass analyzer many times if desired.

According to an aspect of the present invention, an aerosol particle analysis system is provided, which includes:

an ablation chamber configured to receive aerosol particles through an opening;

a laser source configured to ablate the aerosol particles in the ablation chamber;

a conduit configured to be filled with a buffer gas and connected to the ablation chamber; and a mass spectrometer connected to the gas conduit.

The ablation chamber and the conduit may be two separate chambers that are connected through another opening. Alternately, the ablation chamber and the conduit may be a single chamber of integral construction without any significant restriction on particle flow therebetween.

In one embodiment, the conduit includes an electromagnetic multipole structure.

In another embodiment, the aerosol particle analysis system further includes an aerosol particle supply system attached to the ablation chamber through the opening, wherein the aerosol particle supply system is configured to supply aerosol particles into the ablation chamber.

In even another embodiment, the aerosol particle supply system is an aerodynamic lens system.

In yet another embodiment, the aerosol particle analysis system further includes a vacuum enclosure that houses the conduit and the mass spectrometer.

In still yet another embodiment, the aerosol particle analysis system further includes a first vacuum pump configured to provide pumping to the conduit.

In a further embodiment, the aerosol particle analysis system further includes a second vacuum pump configured to provide pumping to the mass spectrometer.

In an even further embodiment, the aerosol particle analysis system further includes a first window on the ablation chamber, wherein the first window is configured to be in the path of a laser beam from the laser source into the ablation chamber.

In a yet further embodiment, a laser beam from the laser source has a focal point within a path of the aerosol particles.

In a still yet further embodiment, the mass spectrometer is a time-of-flight mass spectrometer.

In another embodiment, the aerosol particle analysis system further includes a plurality of electrodes located in the conduit and configured to provide an alternating electric field to a beam of ions of the ablated aerosol particles traveling in the conduit.

In even another embodiment, the frequency of the alternating electric field can be changed to select the low mass limit of the ions trapped in the conduit.

In yet another embodiment, the frequency of the alternating electric field can be changed to select the low mass limit of the ions trapped in the conduit.

In still another embodiment, the wave form of the alternating electric can be adjusted to mass select the ions in the conduit.

In yet further another embodiment, the ablation chamber is configured to receive the aerosol particles continuously, and wherein the mass spectrometer provides elemental composition of the ions of the ablated aerosol particles continuously in real time.

According to another aspect of the present invention, a method of analyzing composition of aerosol particles is provided, which includes:

providing an instrumentation including an ablation chamber, a conduit, and a mass spectrometer;

supplying aerosol particles into the ablation chamber through an opening in the ablation chamber;

ablating the aerosol particles in the ablation chamber, wherein the aerosols particles are decomposed into ions of ablated aerosol particles having lesser mass after ablation;

flowing a buffer gas into the conduit, wherein speed of the ions of the ablated aerosol particles is reduced by the buffer gas, and wherein the ions of the ablated aerosol particles pass through the conduit; and analyzing mass-to-charge distribution of the ions of the ablated aerosol particles in the mass spectrometer.

In one embodiment, the method further includes collimating ions of the ablated aerosol particles within the conduit.

In another embodiment, the ions of the aerosol particles are collimated by applying an electrical signal to an electromagnetic multipole structure provided within the conduit.

In even another embodiment, the aerosol particles are ablated by irradiation from a laser beam from a laser source onto the aerosol particles.

In yet another embodiment, the ablation chamber includes a first window and a second window, and wherein the laser beam is transmitted through the first window into the ablation chamber and through the second window and out of the ablation chamber.

In still yet another embodiment, the method further includes flowing a buffer gas into the ablation chamber through a gas inlet attached to the conduit, wherein the buffer gas induces a positive flow of gas from the gas inlet toward the ablation chamber.

In a further embodiment, the method further includes inducing structural breakdown of the ions of the ablated aerosol particles within the conduit by collision with the buffer gas, wherein average mass of the ablated ions from the aerosol particles decreases after the structural breakdown.

In an even further embodiment, the instrumentation includes an aerosol particle supply system attached to the ablation chamber through the opening, wherein the aerosol particle supply system is configured to supply the aerosol particles into the ablation chamber.

In a still further embodiment, the conduit and the mass spectrometer are housed within a vacuum enclosure, wherein a first vacuum pump is connected to the conduit to provide pumping, and wherein a second vacuum pump is connected to the vacuum enclosure to provide pumping to the mass spectrometer.

In further another embodiment, the method further includes deflecting the ablated ions from the aerosol particles employing a beam deflector after the ions of the ablated aerosol particles pass through another opening between the conduit and the mass spectrometer, wherein the mass spectrometer is a time-of-flight mass spectrometer.

DETAILED DESCRIPTION OF THE INVENTION

As stated above, the present invention relates to analytical instrumentation and methods of operating the same, which are now described in detail with accompanying figures. It is noted that proportions of various elements in the accompanying figures are not drawn to scale to enable clear illustration of elements having smaller dimensions relative to other elements having larger dimensions.

Figure 1:
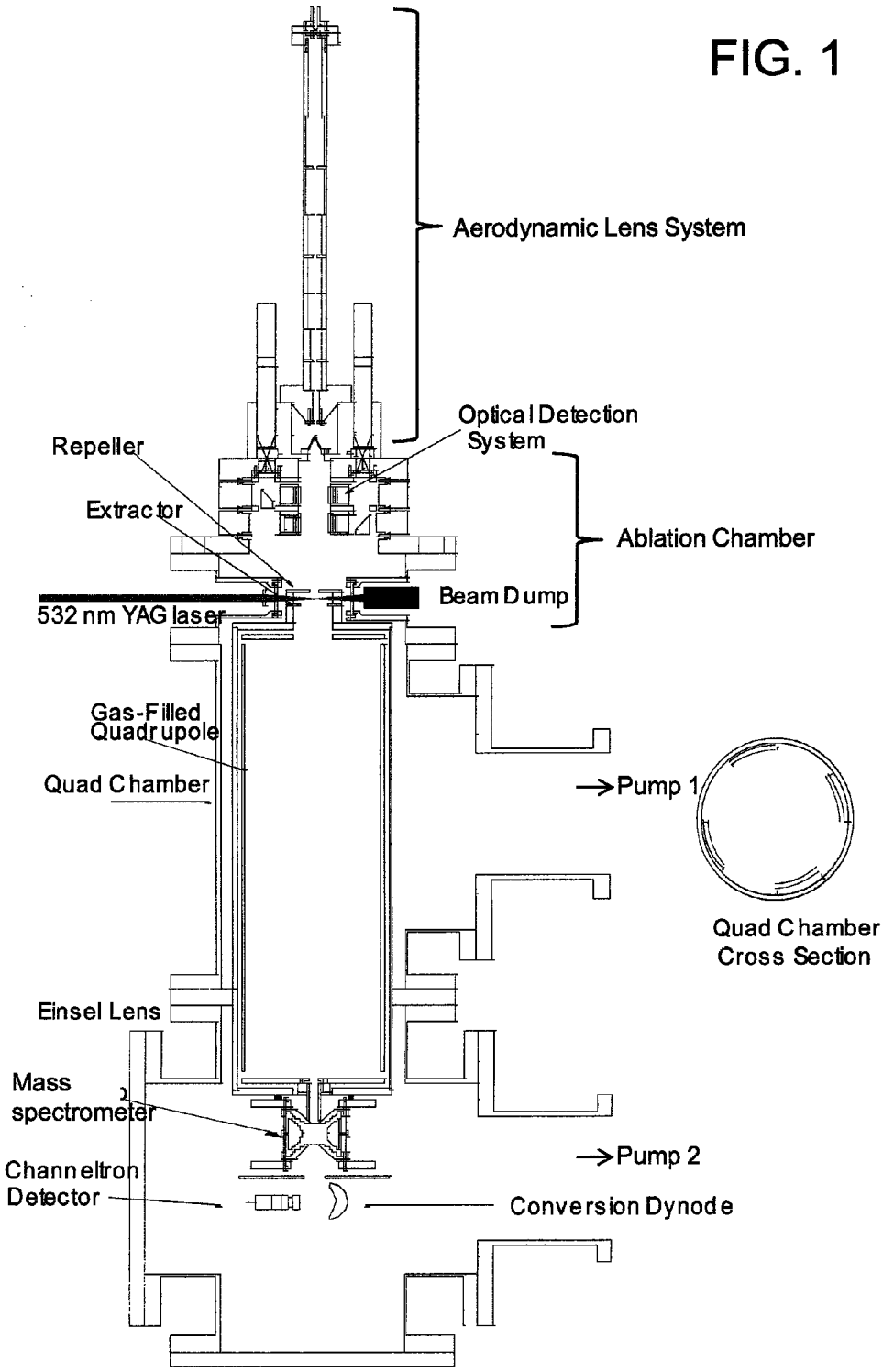
FIG. 1 includes a schematic vertical cross-sectional view of a first exemplary instrumentation that includes an aerodynamic lens system, an ablation chamber, a gas-filled conduit and, an ion trap mass spectrometer. A gas-filled quadrupole chamber is employed for the gas-filled conduit. A horizontal cross-sectional view of the gas-filled quadrupole chamber is also shown.

Referring to FIG. 1, a first exemplary instrumentation includes an aerosol particle supply system, an ablation chamber, a gas-filled conduit, and an ion trap mass spectrometer. The aerosol particle supply system and the ablation chamber are connected to each other through a first opening, which is an orifice at the outlet of the aerodynamic lens system. The ablation chamber and the gas-filled conduit are connected through a second opening. The gas-filled conduit and the ion trap are connected through a third opening. The ion trap mass spectrometer, and the gas-filled conduit are housed in a vacuum enclosure, which maintains the instrumentation inside in vacuum conditions. The ion trap mass spectrometer may include a detection system such as a combination of a channeltron detector and a conversion dynode.

The aerosol particle supply system is attached to the ablation chamber through a first opening. The aerosol particle supply system supplies aerosol particles into the ablation chamber either continuously or in a pulse mode. In a real-time analysis mode, the aerosol particle supply system preferably supplies the aerosol particles into the ablation chamber continuously. The aerosol particle supply system can be, for example, an aerodynamic lens system known in the art. For example, an aerodynamic lens system disclosed by Wang et al., "A design Tool for Aerodynamic Lens System," AEROSOL SCIENCE AND TECHNOLOGY 40:320-334 (2006) can be employed for the purposes of the present invention. Alternately, any other aerodynamic lens system such as one discloses in U.S. Pat. No. 5,067,801 to Mirels. et al. can be employed instead.

The aerosol particle supply system is configured to provide a flux of aerosol particles into the ablation chamber. The aerosol particles exiting from the aerosol lens system into the ablation chamber forms a collimated beam of aerosol particles that travel in a narrow spherical angle. The pressure of the ablation chamber is controlled by a vacuum pump (not shown) that is connected to a port (not shown) on a wall of the ablation chamber. The vacuum pump can be any conventional pump such as a rotary pump or a turbomolecular pump.

For example, airborne particles can be sampled as aerosol particles through an inlet, i.e., the first opening, into the ablation chamber. The aerosol particles can be collimated into a tight particle beam using a system of aerodynamic lenses or skimmed into a particle beam.

A light scattering detector can be mounted on an upper portion of the ablation chamber in the path of the aerosol particles between the first opening and an ablation point, which is a point in the path of the aerosol particles at which a laser beam hits the aerosol particles. If a particle is large enough to be detected by light scattering, the particle can be aerodynamically sized on the way into the ablation chamber. The light scattering detector detects passage of said aerosol particles during transit along the ablation chamber. Preferably, the light scattering detector detects passage of the aerosol particles during transit one at a time. The light scattering signals can be used to trigger the ablation laser to hit the particle when it reaches the focal point of the laser. The tightly focused laser provides high intensity light that completely vaporizes the particle. The laser source can be triggered by a detection signal from said light scattering detector with a calculated time delay. A plurality of light scattering detectors can be employed to calculate the time delay needed for each aerosol particle that passes by so that the time delay can be accurately calculated for each aerosol particle that passes by.

The pressure of the ablation chamber is maintained above the high vacuum pressure range, i.e., above $1.0\times10^{-5}$ Torr. Preferably, the ablation chamber is maintained at a pressure from 0.1 mTorr to 30 mTorr, and preferably from 1 mTorr to 10 mTorr, although lesser and greater pressures are also contemplated herein. This enables a high level of ion flux from the ablated aerosol particles to be slowed and captured in a large ion trap where the charge distribution of the ions is reduced so that multiply charged ions concentrations are minimize and the distribution of ions injected into the mass analyzer is representative of the composition of the particle with prior art ablation chambers that house a mass spectrometer and need to be maintained at a pressure in the high vacuum range, i.e., below $1.0\times10^{-5}$ Torr only a minute portion of the ions from the particle could be sampled through the mass spectrometer for analysis without reduction of the charge distribution and the measured ion distribution is not necessarily representative of the particle composition.

The ablation chamber is configured to allow illumination of a laser beam on the beam of the aerosol particles. For example, a laser source is provided on the outside of the ablation chamber. The ablation chamber can have a first window through which to illuminate a laser beam from the laser source into the ablation chamber. The orientation and focus of the laser beam can be adjusted so that the focal point of the laser beam coincides with a point in the path of the beam of the aerosol particles. The laser source ablates the aerosol particles in the ablation chamber.

The ablation chamber can include a first window and a second window. The first window is configured to be in the path of a laser beam from the laser source into the ablation chamber. The second window is located on the ablation chamber and at an opposite side of the first window. A beam stop can be provided outside the second window. The beam stop is configured to absorb residual energy from the laser beam. Typically, the first window, the second window, and the beam stop are located on a path of the laser beam in a straight line. Thus, the laser beam can be transmitted through the first window into the ablation chamber and through the second window and out of the ablation chamber. The laser beam impinges onto a beam stop after passing through the second window. The beam stop absorbs energy of the laser beam.

As the aerosol particles flow through the ablation chamber, the aerosol particles are ablated by irradiation of a laser beam from a laser source onto the aerosol particles. For example, an intense laser pulse can be applied to the aerosol particles to atomize and cationize all of the aerosol particle by ablation. The aerosol particles are decomposed into ablated aerosol ions having lesser mass after ablation. Preferably, a focal point of the laser beam is in a path of the aerosol particles within the ablation chamber to maximize the efficiency of the laser beam.

The ablation chamber is large enough to catch all of the ions created from the aerosol particles after ablation. The gas-filled quadrupole functions as a large capacity ion trap (LCIT). By a combination of the initial kinetic energy of the aerosol particles prior to ablation and the electrostatic voltage bias across a repeller and an extractor, the ions are directed into the conduit. The ablated aerosol particle's ions are trapped in the LCIT where they mix. A statistically representative portion of the ions is ejected out of the LCIT to be subsequently analyzed for composition. Typically, so many ions are created from a single aerosol particle that thousands of mass spectra could be measured from a single particle to provide precise isotope ratios. In prior art instruments, a mass spectrometer cannot adequately deal with the huge number of ions that can be produced from even a single aerosol particle because the sheer number of ions produced by ablation of the aerosol particle creates a space charge effect that overwhelms the fields imposed by the mass spectrometer.

The laser beam is intense enough to completely atomize and cationize most types of particles. In some cases, however, some of the vaporized materials can recombine during the ablation process. The ablation chamber in which the aerosol particles are vaporized and ionized needs to have enough capacity to hold large portion of the ions created by laser ablating the aerosol particle. A particle with a diameter of one micrometer has approximately $3\times10^{10}$ atoms therein so that the ablation chamber needs to hold at least $10^{11}$ ions to capture all of the ions from a single one micrometer diameter particle.

In one embodiment, the ablation chamber and the conduit may be two separate chambers, and the conduit is connected to the ablation chamber through a second opening. In another embodiment, the ablation chamber and the conduit form a single chamber of integral construction without any significant restriction on particle flow therebetween. An upper portion of an integrated chamber may be the ablation chamber and the lower portion of the integrated chamber may be the conduit.

The conduit is configured to be filled with a buffer gas at a pressure substantially equal to or minimally greater than the pressure in the ablation chamber. When the conduit is filled with a buffer gas, the conduit is referred to as a "gas-filled conduit." The gas-filled conduit also functions as a large capacity ion trap. The gas-filled conduit is maintained at a pressure above $1.0\times10^{-5}$ Torr, and preferably from 0.1 mTorr to 30 mTorr, and more preferably from 1 mTorr to 10 mTorr. As the ions of the ablated aerosol particles pass through the gas-filled conduit, the buffer gas induces translational cooling of the ions of the ablated aerosol particles. The buffer gas can be, for example, $H_2$, He, $N_2$, $O_2$, Ne, Ar, Xe, or a combination thereof. Typically, the ablation chamber is substantially at the same pressure as the gas-filled conduit.

The buffer gas can be flowed into the conduit through a gas inlet attached to the conduit and configured to induce a positive flow of gas from the gas inlet toward the second opening within the conduit. Typically, the gas inlet is attached to the portion of the conduit in proximity to the third opening, which is an exit opening for the ions of the ablated aerosol particles. The speed of the ions of the ablated aerosol particles is reduced by the buffer gas as collision with the buffer gas cools the ions of the ablated aerosol particles and reduces the momentum during the passage in the conduit toward the third opening. Preferably, the ions of the ablated aerosol particles become substantially stationary within the conduit near the third opening by the collision with the buffer gas. The buffer gas also reduces the average electrical charge of the ions of the ablated aerosol particles within the conduit because multiply charged ions of the ablated aerosol particles exchanges electrical charges with the buffer gas through collision within the gas-filled conduit.

The gas-filled conduit can be provided with a set of electrodes configured to provide electromagnetic fields to collimate and trap the ions of the ablated aerosol particles. In this case, the conduit includes an electromagnetic multipole structure. If four electrodes are employed for the electromagnetic multipole structure as shown in the cross-sectional view, the electromagnetic multipole structure is an electromagnetic quadrupole structure. In this case, the conduit is a quadrupole chamber, or a "quad chamber."

Typically, a vacuum enclosure houses the gas-filled conduit and the mass spectrometer. The vacuum enclosure can be divided into two portions separated by the gas filled conduit. A first vacuum pump configured to provide pumping to the gas-filled conduit is mounted on the side of the second opening so that the gas-filled conduit is maintained at a pressure from 0.1 mTorr to 30 mTorr. The first vacuum pump can provide pumping to the gas-filled conduit through the ablation chamber. The first vacuum pump can be a rotary pump, a turbomolecular pump, an ion pump, a cryogenic pump, or a combination thereof.

Typically, the conduit includes an electromagnetic multipole structure, which can be, for example, an electromagnetic quadrupole structure. The plurality of electrodes located in the gas-filled conduit is configured to provide alternating current signal to a beam of the charged particles of the ablated aerosol particles traveling in the conduit. The electromagnetic field focuses the beam of the charged particles, i.e., ions, of the ablated aerosol particles along the beam path.

In one embodiment, the electromagnetic field induces collimation and trapping of the ions without inducing any further fragmentation of the ions of the ablated aerosol particles. In another embodiment, the electromagnetic field includes a component that enhances collision of the ions of the ablated aerosol particles with the buffer gas, i.e., the collision of the ions of the ablated aerosol particles with the buffer gas is enhanced by applying an electromagnetic bias voltage to an electromagnetic multipole structure within the conduit. The ions are further decomposed into particles having lesser atomic weight as well as focusing the broken-down aerosol particles. The average mass of the ions of the ablated aerosol particles decreases after the structural breakdown. In this embodiment, the plurality of electrodes is configured to provide an electromagnetic field that induces breakdown of ablated particles in the beam into particles having lesser atomic weight. In both embodiments, the ions of the ablated aerosol particles are collimated and trapped within the conduit with or without reduction in the average atomic or molecular mass.

The frequency, voltage, and/or waveform applied to the electromagnetic multipoles can be changed to mass select ions trapped in the gas-filled conduit. The waveform can be a high voltage sine wave or square wave depending on how it is generated. In a preferred embodiment, square wave potentials is digitally synthesized.

An Einzel lens system can be used in the conduit to focus the ions in flight by manipulating the electric field in the path of the ions. An Einzel lens system includes at least three sets of conductive plates in series along the axis of the ion beam. Each pair of conductive plates is placed to surround the beam path so that an electric field can be applied to deflect ions that pass through the space between the pair of conductive plates. Typically, the conductive plates are symmetric so the ions maintain their initial speed but alter the direction of movement upon exiting the lens to converge on the axis of the Einzel lens system. In general, the beam of the aerosol particles is collimated by applying at least one electrical signal to the electromagnetic multipole structure provided within the conduit. The Einzel lens system, if present, further facilitates the focusing of the ions of the ablated aerosol particles.

A mass spectrometer can be connected to the gas conduit directly through a third opening, or can be connected to the gas conduit indirectly through the third opening, the ion trap, and a fourth opening which is the opening between the ion trap and the chamber including the mass spectrometer. The mass-to-charge distribution of the ions of the ablated aerosol particles are analyzed in the mass spectrometer. The mass spectrometer shown in FIG. 1 also functions an ion trap. The unit of the mass-to-charge is unit atomic mass per unit charge, i.e., 1/12 of the mass of carbon 12 to the electrical charge of a single proton. If the ablation chamber is configured to receive the aerosol particles continuously, the mass spectrometer can provide data on the mass-to-charge ratio of the ions from the ablated aerosol particles continuously in real time. The measurement or isotope ratios and elemental composition of the ions of the ablated aerosol particles can be aided, for example, using tandem mass spectrometry techniques.

A second vacuum pump is attached to the portion of the vacuum enclosure including the mass spectrometer. The second vacuum pump is configured to provide pumping to the mass spectrometer so that the mass spectrometer is maintained at an high vacuum pressure, i.e., at a pressure below $1.0\times10^{-5}$ Torr, and preferably below $3.0\times10^{-6}$ Torr, and more preferably below $3.0\times10^{-6}$ Torr.

The present invention provides a real-time method for the measuring elemental composition and precise isotope ratios of individual particles. Currently, isotope ratio measurements are done in a laboratory at a great expense. According to the present invention, individual particles in the 1-μm range and lesser can be measured in real time and on site. Such measurement can be performed without any pretreatment of the sample, and still provide a high level of sensitivity. The present invention can be practiced on site with a transportable instrument.

Figure 2:
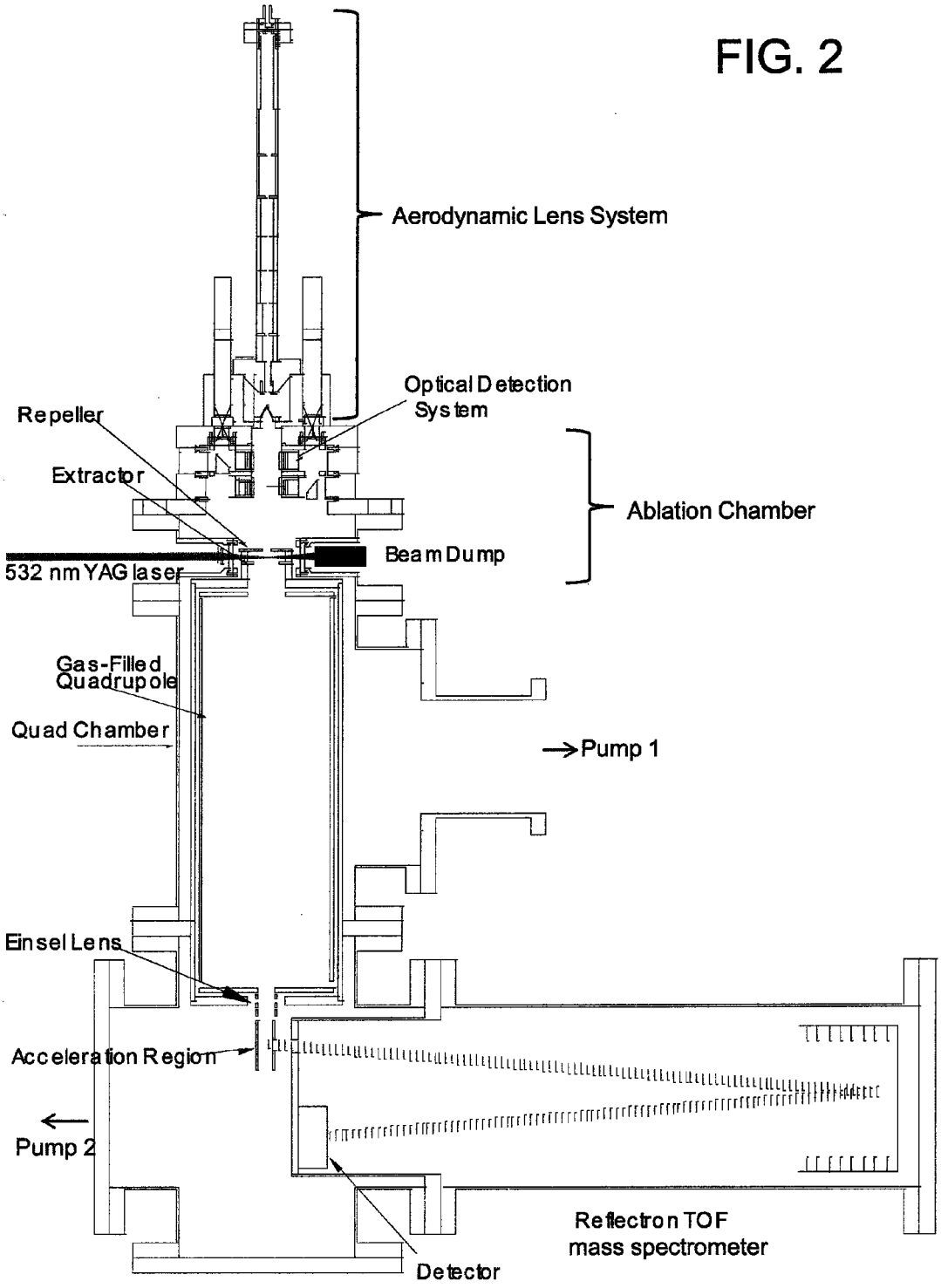
FIG. 2 shows a schematic vertical cross-sectional view of a second exemplary instrumentation that includes an aerodynamic lens system, an ablation chamber, a gas-filled conduit, and an orthogonal time-of-flight mass spectrometer. A gas-filled quadrupole chamber is employed for the gas-filled conduit.

FIG. 2 shows a schematic vertical cross-sectional view of a second exemplary instrumentation that includes an aerodynamic lens system, an ablation chamber, a gas-filled conduit, a beam deflector, and a time-of-flight mass spectrometer. A gas-filled quadrupole chamber is employed for the gas-filled conduit.

In the second exemplary instrumentation, the mass spectrometer is a time-of-flight mass spectrometer. The second exemplary instrumentation includes a beam deflector configured to deflect the ions of the ablated aerosol particles into a time-of-flight mass spectrometer after the ions pass through the third opening.

The time-of-flight mass spectrometer performs time-of-flight mass spectrometry (TOFMS), in which ions are accelerated by an electric field of known strength. This acceleration results in an ion having the kinetic energy proportional to the electrical charge of the particle. Because the mass of the ions are different despite the same electrical charge, the velocity of the ions depends on the mass-to-charge ratio. Thus, the time each ion spends in flight to reach a detector at a known distance is also dependent on the mass-to-charge ratio. Heavier particles travel at lower speeds, while lighter particles with the same electrical charge travel at higher speeds. Thus, the mass-to-charge ratio of each ion can be determined by measuring the time it spends during transit.

A tandem mass spectrometry method, which is also referred to as "TOF/TOF" method, can also be employed, in which two time-of-flight mass spectrometers are used consecutively. The first time-of-flight mass spectrometer (TOF-MS) is used to separate the precursor ions, and the second TOF-MS analyzes the product ions. Optionally, an ion gate can be employed to select a precursor ion. Anion fragmentation region and an ion accelerator can be provided between the first and second TOF-MS.

If the mass analyzer is another ion trap, tandem mass spectrometry methods can be used to fragment any interfering polyatomic ions that can coexist out of the region of the atomic analyte of interest. The above aerosol mass spectra illustrate the process for using tandem mass spectroscopy ("MS/MS") techniques to remove the interfering polyatomic ions from the region of the atomic analyte that are present when low intensity (relatively) laser ablation is used to ablate the particle and create the ions.

Figure 3:
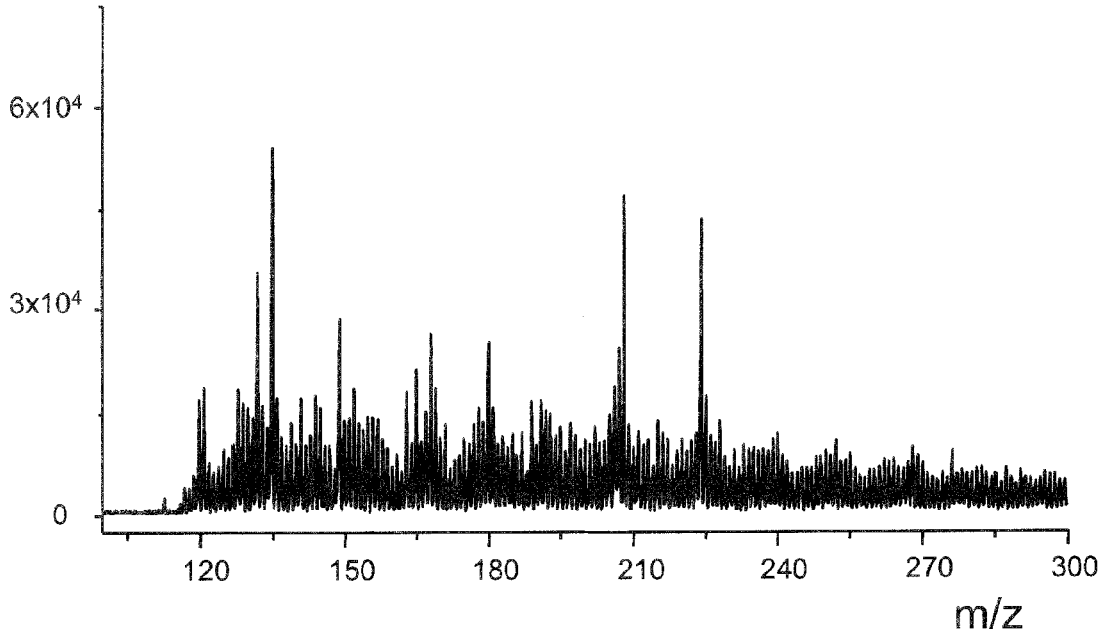
FIG. 3 is a graph showing the distribution of mass-to-charge ratio in ions of the ablated aerosol particles obtained from an air sample from St. Louis.

FIG. 3 is a graph showing the distribution of mass-to-charge ratio in ions of the ablated aerosol particles obtained from an air sample from St. Louis. This is the averaged particle mass spectrum of NIST standard reference material.

Figure 4:
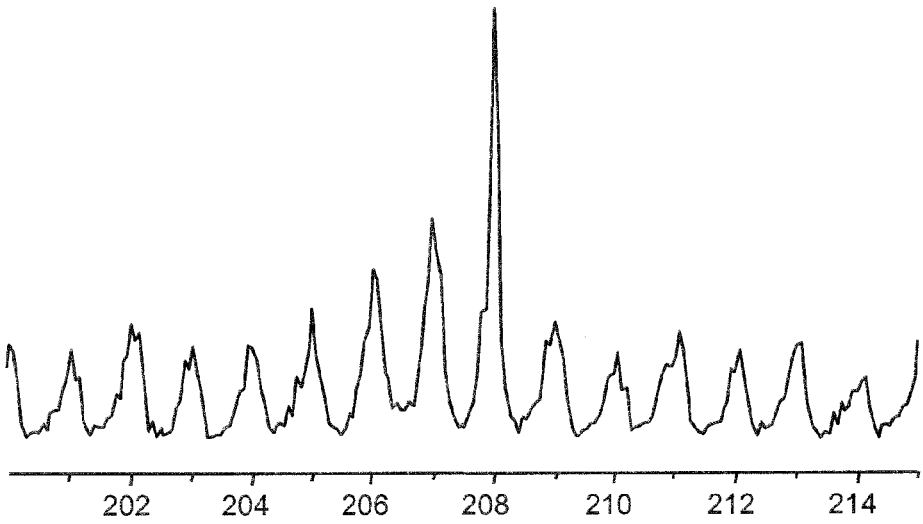
FIG. 4 is a magnified view of the graph in FIG. 3 for the mass-to-charge ratio range from 200 to 215.

FIG. 4 is a magnified view of the graph in FIG. 3 for the mass-to-charge ratio range from 200 to 215, which shows the ions in the vicinity of lead ions.

Figure 5:
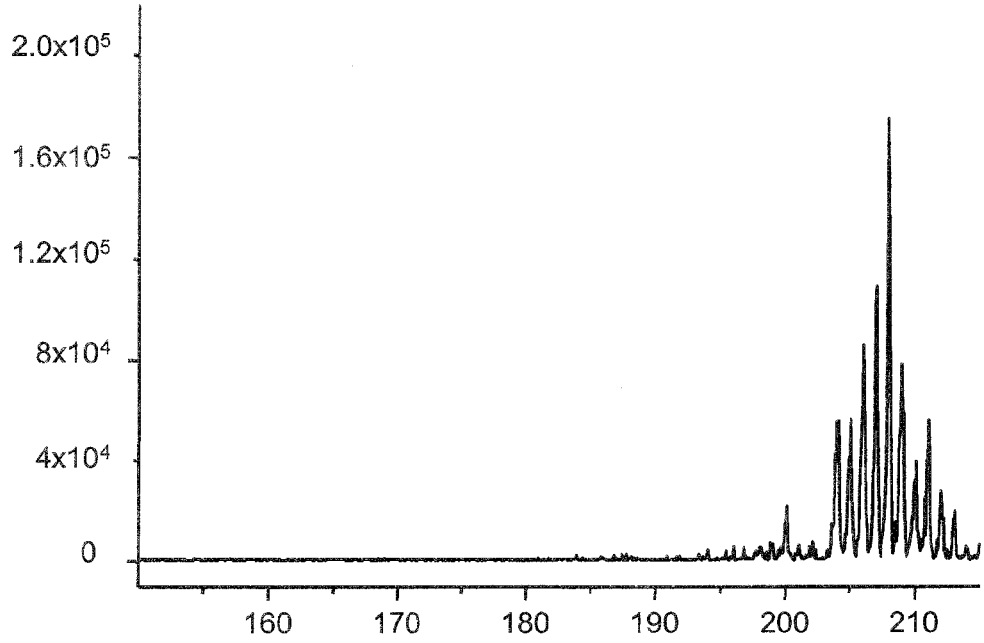
FIG. 5 is a graph showing the distribution of mass-to-charge ratio of ions of the ablated aerosol particles that are selected within a predefined mass-to-charge range without inducing additional breakdown of the ions of the ablated aerosol particles within a gas-filled quadrupole chamber.

FIG. 5 is a graph showing the distribution of mass-to-charge ratio of ions of the ablated aerosol particles preselected with a mass-to-charge range filter so that the predominant particles have a mass-to-charge value from about 204 to about 210. No additional breakdown of the ions of the ablated aerosol particles were induced after preselecting the mass-to-charge range.

Figure 6:
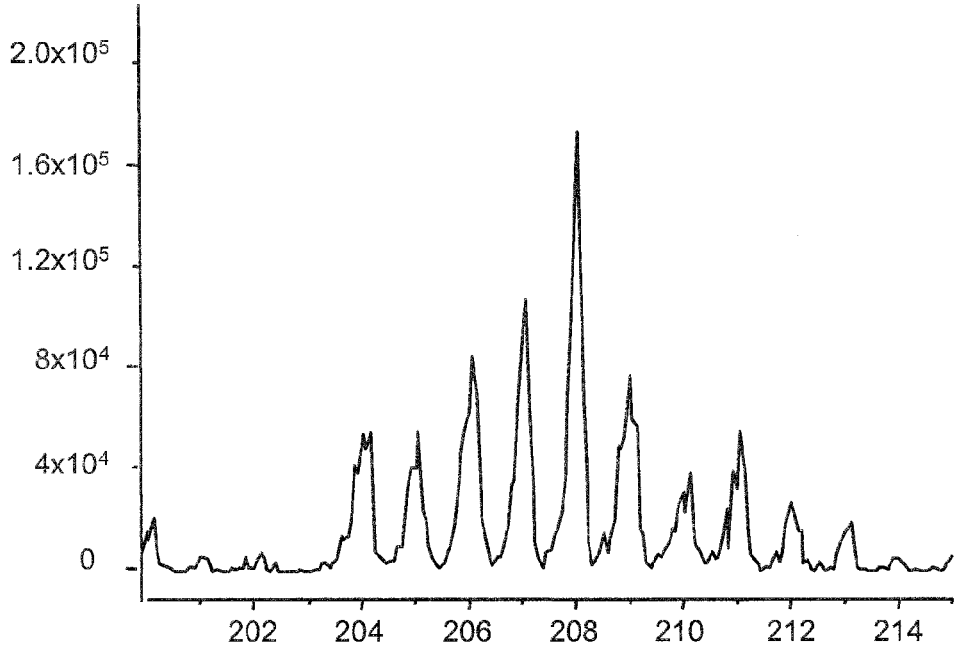
FIG. 6 is a magnified view of the graph in FIG. 5 for the mass-to-charge ratio range from 200 to 215.

FIG. 6 is a magnified view of the distribution of the mass-to-charge ratio in FIG. 5 in the mass-to-charge range from 200 to 215.

Figure 7:
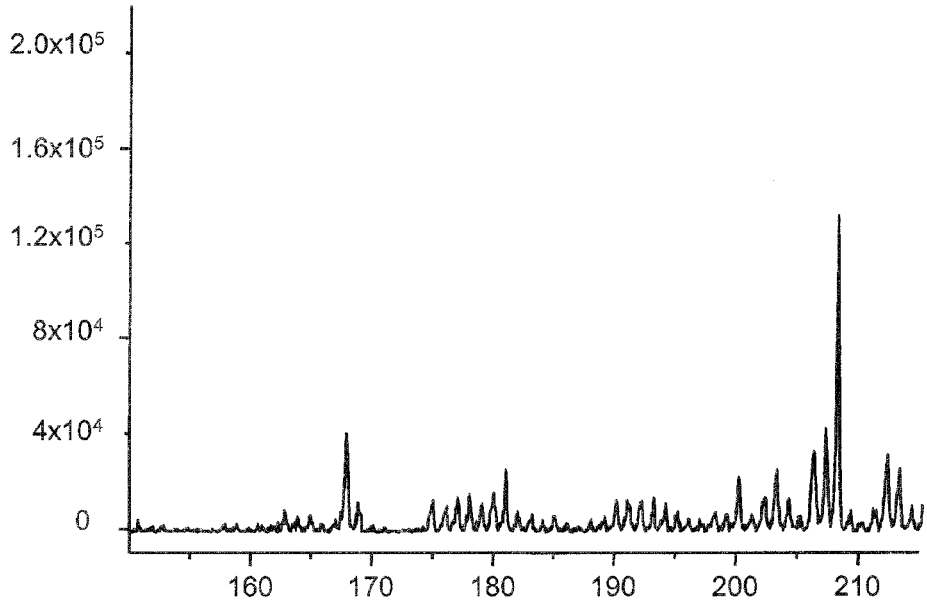
FIG. 7 is a graph showing the distribution of mass-to-charge ratio of ions of the ablated aerosol particles that are selected within a predefined mass-to-charge range after inducing additional breakdown of the ions of the ablated aerosol particles within a gas-filled quadrupole chamber.

FIG. 7 is a graph showing the distribution of mass-to-charge ratio of ions of the ablated aerosol particles that are preselected within a predefined mass-to-charge range and subsequently subjected to additional breakdown within a gas-filled quadrupole chamber. The collision induced dissociation of the polyatomics forms particles having less atomic numbers. The ions below the mass-to-charge of 200 result from polyatomic ions in the range of the lead isotope ions that have been fragmented out of the mass region.

Figure 8:
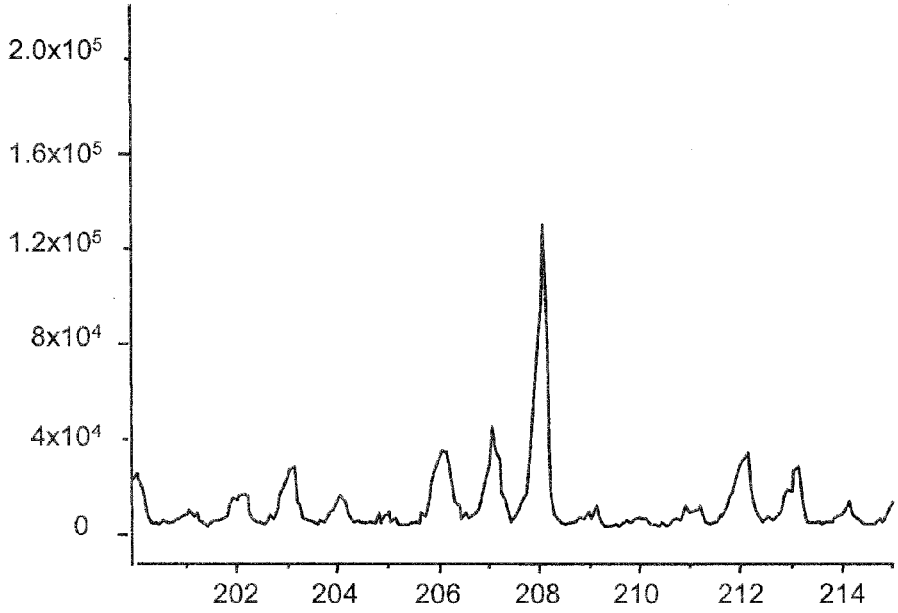
FIG. 8 is a magnified view of the graph in FIG. 7 for the mass-to-charge ratio range from 200 to 215.

FIG. 8 is a magnified view of the graph in FIG. 7 for the mass-to-charge ratio range from 200 to 215. Additional polyatomic ions that are not present in FIG. 6 are visible in this graph, illustrating detection of the fragmented ions due to collision in the gas-filled quadrupole chamber. The MS/MS technique permits the lead isotopes ratios to be measured. These spectra show that atomic ions can be isolated and detected in heavy polyatomic ion backgrounds.

Intense laser ablation permits more ions to be created without matrix effects and with much better atomization occurring during the ablation process. Intense laser ablation should reduce the need for tandem mass spectrometry. In case large polyaromatic hydrocarbons survives the intense laser ablation process, tandem mass spectroscopy techniques can be employed to assure correct isotope ratio measurement.

Commercial ion traps having a radius of 1 cm hold on the order of $10^5$-$10^6$ ions. Therefore, many experiments (theoretically greater than 10,000) can be done on the ions from a single 1 μm sized particle. Selective injection into the mass analyzer as a function of time can be used to define relative elemental compositions and provide precise isotope ratios. Relative composition could be correlated to aerodynamic particle size to obtain a semi-quantitative measurement of the amount of analyte in the particle. Precise isotope ratio measurements on individual particles in the 1-μm range and lower in real time and on site.

The prior art instruments have inherent limitation in that they cannot handle the enormous number of ions produced. In order for their measured ion distributions to be correct, the particles have to be homogeneous. Further, the prior art instruments cannot deal with large disparities in elemental concentrations or compositional morphologies. For example, if a particle is made of a 50:50 mixture of AB and CD, the mass spectrum from a prior art instrument will yield completely different results for the case in which the center of the particle is pure AB and the outer layer is pure CD than for the case in which the layers were reversed in position. This is because of the dynamics of the ablation process and because only a relatively small number of ions are sampled into the flight tube. With the instrument of the present invention, the correct result is always obtained because vast quantities of ions are caught and trapped before they are mass-analyzed.

The present invention enables mass selection of the ions by employing a large-radius gas-filled linear quadrupole ion trap (LR-LQIT). As discussed above, the gas-filled conduit may be a quadrupole ion trap having a large diameter (e.g., a diameter greater than 5 cm, and preferably greater than 10 cm), in which case the gas-filled conduit is referred to as the large-radius gas-filled linear quadrupole ion trap. The waveform of the electrical bias applied to the LR-LQIT can be changed so that ions of interest can be trapped while the less interesting or are excluded from the measurement, which is a feature not provided in the prior art instruments.

The present invention enables measurement of ions with widely varying concentrations if the mass analyzer is an ion trap mass spectrometer. If the ratio of element A to element B is 100:1, the ion trap can be set up to trap only A and the ions can be injected into the small ion trap for one time unit. Then the experiment can be done again with the trap set up to trap B. This time the ions are injected for 100 time units. The ion intensities of A and B would then be comparable and an accurate ratio would be determined by dividing the B ion intensity by 100. In general, the ion trap may be employed to trap multiple species for different time durations so that a total ion count for each species as measured by the mass spectrometer is comparable for each ion species.

The present invention provides analysis of accurate elemental composition and isotope analysis on an individual particle basis. In contrast to the prior art instruments, the present invention provides accurate analysis not only for homogeneously composed particles, i.e., particles, but also for non-homogeneous particles as well. Thus, the present invention may be employed to analyze a sample of aerosol particles including at least one non-homogeneous particle such that the result of the analysis is independent of the location of individual atoms within the non-homogeneous particle.

While the invention has been described in terms of specific embodiments, it is evident in view of the foregoing description that numerous alternatives, modifications and variations will be apparent to those skilled in the art. Other suitable modifications and adaptations of a variety of conditions and parameters normally encountered in molecular biology, protein chemistry, and protein modeling, obvious to those skilled in the art, are within the scope of this invention. All publications, patents, and patent applications cited herein are incorporated by reference in their entirety for all purposes to the same extent as if each individual publication, patent, or patent application were specifically and individually indicated to be so incorporated by reference. Accordingly, the invention is intended to encompass all such alternatives, modifications and variations which fall within the scope and spirit of the invention and the following claims.

What is claimed is:

1. A method of analyzing composition of aerosol particles comprising:

providing an instrumentation including an ablation chamber, a conduit, and a mass spectrometer;

supplying aerosol particles into said ablation chamber through an opening in said ablation chamber wherein said ablation chamber is maintained at a reduced pressure greater than $1.0\times10^{-5}$ Torr and less than 30 mTorr;

ablating said aerosol particles during transit in said ablation chamber at said reduced pressure, wherein said aerosols particles are decomposed into ions of ablated aerosol particles having lesser mass after ablation;

flowing a buffer gas into said conduit, wherein speed of said ions of said ablated aerosol particles is reduced by said buffer gas, and wherein said ions of said ablated aerosol particles pass through said conduit; and analyzing mass-to-charge distribution of said ions of said ablated aerosol particles in said mass spectrometer.

2. The method of claim 1, further comprising collimating said ions of said ablated aerosol particles within said conduit.

3. The method of claim 2, wherein said ions of said aerosol particles are collimated by applying an electrical signal to an electromagnetic multipole structure provided within said conduit.

4. The method of claim 3, wherein said electromagnetic multipole structure is an electromagnetic quadrupole structure.

5. The method of claim 3, wherein said aerosol particles are ablated by irradiation from a laser beam from a laser source onto said aerosol particles.

6. The method of claim 5, wherein said ablation chamber comprises a first window and a second window, and wherein said laser beam is transmitted through said first window into said ablation chamber and through said second window and out of said ablation chamber.

7. The method of claim 6, wherein said laser beam impinges onto a beam stop after passing through said second window, wherein said beam stop absorbs energy of said laser beam.

8. The method of claim 6, wherein a focal point of said laser beam is in a path of said aerosol particles within said ablation chamber.

9. The method of claim 8, further comprising flowing a buffer gas into said conduit through a gas inlet attached to said conduit, wherein said buffer gas induces a positive flow of gas from said gas inlet toward said ablation chamber.

10. The method of claim 9, wherein said buffer gas reduces an average electrical charge of said ions of said ablated aerosol particles within said conduit.

11. The method of claim 9, further comprising inducing structural breakdown of said ions of said ablated aerosol particles within said conduit by collision with said buffer gas, wherein average mass of said ions of said ablated aerosol particles decreases after said structural breakdown.

12. The method of claim 11, wherein said collision with said buffer gas is enhanced by applying an electromagnetic bias voltage to an electromagnetic multipole structure within said conduit.

13. The method of claim 1, wherein said instrumentation includes an aerosol particle supply system attached to said ablation chamber through said opening, wherein said aerosol particle supply system is configured to supply said aerosol particles into said ablation chamber.

14. The method of claim 13, wherein said ions of said ablated aerosol particles become substantially stationary within said conduit near another opening to said mass spectrometer by said collision with said buffer gas.

15. The method of claim 14, further comprising deflecting said ions of said ablated aerosol particles into a time-of-flight mass spectrometer after said ions of said ablated aerosol particles pass through said another opening.

16. The method of claim 13, wherein said aerosol particle supply system is configured to provide a flux of said aerosol particles into said ablation chamber at a pressure from 0.1 mTorr to 30 mTorr.

17. The method of claim 1, wherein said conduit and said mass spectrometer are housed within a vacuum enclosure, wherein a first vacuum pump is connected to said conduit to provide pumping, and wherein a second vacuum pump is connected to said vacuum enclosure to provide pumping to said mass spectrometer.

18. The method of claim 17, further comprising:

maintaining a pressure of said conduit at a pressure from 0.1 mTorr to 30 mTorr; and maintaining a pressure of said mass spectrometer at a pressure below $1.0\times10^{-5}$ Torr.

19. The method of claim 1, further comprising generating an electromagnetic field in said conduit by providing a plurality of electrodes located therein, wherein said electromagnetic field focuses said ions of said ablated aerosol particles along a beam path.

20. The method of claim 19, further comprising:

providing said aerosol particles continuously into said ablation chamber; and generating data on mass-to-charge ratio of said ions of said ablated aerosol particles continuously in real time.

21. The method of claim 1, further comprising detecting passage of said aerosol particles during transit along said ablation chamber employing a light scattering detector detects.

22. The method of claim 21, wherein said aerosol particles are ablated by employing a laser source triggered by a detection signal from said light scattering detector with a calculated time delay.

* * * * *